United States Patent [19]

Kitta et al.

[11] Patent Number: 4,648,224

[45] Date of Patent: Mar. 10, 1987

[54] TENDON FOR PRESTRESSED CONCRETE

[75] Inventors: Toshiyuki Kitta, Omiya; Hiroshi Tada, Yokohama; Keizo Ishikawa, Yamato, all of Japan

[73] Assignees: Japanese National Railways; Oiles Industry Co., Ltd., both of Tokyo, Japan

[21] Appl. No.: 712,096

[22] Filed: Mar. 15, 1985

[30] Foreign Application Priority Data

Mar. 28, 1984 [JP] Japan ..... 59-058389

[51] Int. Cl.[4] ..... E04C 3/10

[52] U.S. Cl. ..... 52/223 R; 52/309.14; 52/727; 52/740; 52/DIG. 7; 428/372

[58] Field of Search ..... 52/223 R, 309.13, 309.14, 52/309.15, 309.16, 727, 309.17, 309.3, DIG. 7, 52/740; 428/372, 395

[56] References Cited

U.S. PATENT DOCUMENTS

| | | | |
|---|---|---|---|
| 1,230,475 | 6/1917 | Gardner | 52/727 |
| 2,921,463 | 1/1960 | Goldfein | 52/727 X |
| 3,145,502 | 8/1964 | Rubenstein | 52/309.15 X |
| 4,552,815 | 11/1985 | Dreher et al. | 428/372 X |

*Primary Examiner*—William F. Pate, III
*Assistant Examiner*—Jean M. LaKemper
*Attorney, Agent, or Firm*—Oblon, Fisher, Spivak, McClelland & Maier

[57] ABSTRACT

A tendon for prestressed concrete wherein inorganic particles are coated on an outer surface of a rod made of fiber reinforced plastic through a plastic adhesive layer. The inorganic particles are formed with minute rugged surface portions on the outer surface of the tendon for prestressed concrete, the rugged surface portions being firmly adhered to concrete. The inorganic particles are coated on the whole outer surface of the tendon for prestressed concrete, on the fixed portions at both ends, or on the fixed portions at both ends and on a portion subjected to the maximum bending moment.

3 Claims, 6 Drawing Figures

TENDON FOR PRESTRESSED CONCRETE

BACKGROUND OF THE INVENTION

1. Field of the Invention

This invention relates to a tendon for prestressing a concrete (hereinafter referred to as "PC") structure in accordance with a pretensioning method, and more particularly, to a tendon made of fiber reinforced plastic (hereinafter referred to as "FRP").

The FRP-made tendon refers to a rod-like material (so-called FRP-made rod) or a linear material obtained by impregnating a fiber roving in the form of a bundle comprising a plurality of arranged single fibers having a diameter of a few microns, with a thermosetting resin, drawing it through a molding die, and heating and hardening it.

Since the FRP-made tendon has excellent properties when subjected to high magnetic fields, the ocean environment and corrosive environments, FRP-made tendons have been used under these conditions.

Generally, the PC tendon which is used for tensionings, must meet several requirements depending on the use of PC structures. For example, in PC structures such as PC girders, sleepers or the like, on which a bending moment mainly exerts, cracks occur due to an increase in load, which is the case where a unit stress of concrete reaches a level in excess of the tensile strength of the concrete). In this case, the width of the cracks should not increase rapidly and the length of crack should not grow rapidly. Moreover, the fixed length of ends at the concrete structure and the PC tendon should be short. The fixed length referred to is the length over which a compressive force in the concrete in the axial direction of the PC tendon from the end of the concrete structure becomes constant. The fixed length is also the length over which the rate of increase of tensile force of the tendon becomes constant. In other words, prestress is introduced as much as possible over the overall length of the concrete structure.

These features of the PC tendon have been achieved, with the PC steel materials generally used in the past, by increasing the bonding strength between the PC tendon and the concrete in several different ways. On way has been to intentionally allow the steel material of a PC tendon to rust, which rusting process provides the PC steel rod or PC steel wire with a surface which has recesses or projections. Another way has been to use a PC of stranded steel wire.

However, it is difficult to use the aforementioned FRP-made tendons for pretensioning without modification, since the tendons have a smooth outer circumferential surface, and the bond properties between plastic and concrete is inferior to the bond between steel and concrete.

2. Description of the Prior Art

In view of the advantage of the aforementioned FRP-made tendon, Japanese Patent Application Laid-Open No. 3417/75 has proposed a method for increasing the bond properties relative to concrete.

In the aforesaid prior art, rugged-portion forming processing is applied to the outer surface of an FRP-made rod to form a tendon. The rugged-portion forming processing illustrated in the patent application includes a process in which a fiber roving, impregnated with a thermosetting resin is spirally wound about the outer circumferential surface of the rod and then hardened. Another process shown is a knurling which is applied directly to the outer circumferential surface of the rod, and the like.

However, the FRP-made rod which is prepared by the rugged-portion forming processing still results by the bonding between concrete and plastic. In other words, the plastic has poor wettability relative to the concrete, which makes it difficult to form a firm bond therebetween. A major aspect is to retain tension introduced into the rod by mere rugged engagement in an axial direction of the rod and by a measure of frictional force.

Accordingly, in the above-described prior art, the tension introduced into the FRP-made rod, in other words, the prestress force imparted to the concrete structure relies upon the strength of bond properties of (spiral) convex portions applied to the outer circumferential surface of the rod with respect to the rod.

Also, in the arrangement wherein knurling processing is directly applied to the outer circumferential surface of the FRP-made rod which thereby forms concave portions, unidirectional fibers in the outer periphery of the rod tend to be cut, said cutting of the fibers considerably lowering the tensile strength resistance of the rod. As described above, the prior art involves several problems.

SUMMARY OF THE INVENTION

1. Construction of the Invention

The present invention has been achieved in an attempt of overcoming these problems noted above and provides a tendon for PC in which an outer circumferential surface of an FRP formed from a rod or wire, is surface treated to achieve bond integration and mechanical engagement between the rod and concrete.

The tendon for PC of the present invention is constructed by forming a coating of inorganic particles on an adhesive bonding plastic layer which covers the outer surface of an FRP-made rod.

In the present invention, the synthetic resins which are used in the manufacture of FRP rods used include thermosetting resins such as epoxy resin, unsaturated polyester resin, diallyl phthalate resin and the like. The reinforcing fibers of the FRP are long fiber materials such as glass fibers, carbon fibers, ceramic fibers, aromatic polyamide fibers (Trade mark- Kevlar) and the like.

The plastic bond layer which is formed on the outer surface of the rod includes epoxy resin, unsaturated polyester resin and diallyl phthalate resin, which are similar to the aforesaid synthetic resins used to prepare the FRP, and preferably, resin of the same kind as that for forming FRP.

The inorganic particles coated on the outer surface of the rod through the plastic bond layer include silicon carbide (SiC), aluminum oxide ($Al_2O_3$), silicon dioxide ($SiO_2$), glass and the like. The choice of a particular particle material depends on the environment in which the PC structures is used, which environments include high magnetic field environments, the ocean environment and corrosive environments. If the PC structures are used only for the ocean environment and corrosion environment, a particle of stainless steel is selectively used in addition to the first-mentioned particles.

The above-described inorganic particles have their particle size of approximately 100μ–1000 μm (1/1000 mm).

These particles are coated through the plastic bond layer, with a part embedded into said bond layer and a part exposed to the surface, on the overall outer surface of the rod, on the outer surface of the fixed portions at both ends of the rod, or on the outer surfaces of the fixed portions on the outer surfaces at both ends of the rod and of a portion at least subjecting to a maximum bending moment.

The "portion at least subjecting to a maximum bending moment" herein termed means not to exclude other bending moment occurring parts which give rise to cracks in the concrete structures. That is, if a bending moment part giving rise to a crack is found in advance, the inorganic particles can be coated and formed on the subject part of the FRP-made rod. This is the matter which should be considered in a method for designing members which mainly allows occurrence of cracks resulting from the bending moment.

2. Operation and Effects of the Present Invention

As described above, the outer surface of the tendon for PC is provided with minute rugged surface portions of inorganic particles and a field of the inorganic particles in the form of said rugged surface is exposed as it is. Therefore, mechanical frictional engagement of concrete with the rugged surfaces (anchoring effect) and firm bond between the inorganic particles and concrete occur.

As a consequence, the tendon for PC in accordance with the present invention has excellent effects as follows:

(1) The tension introduced into the tendon is such that prestress is introduced over the approximately full length of the concrete structure with the fixed length.

(2) An increase in width of cracks of concrete produced in parts where bending moment occurs of the concrete structure as a load increases and the growth of length of cracks may be positively prevented.

DESCRIPTION OF THE PREFERRED EMBODIMENT

Operations and effects of the tendon for PC according to the present invention described above have been confirmed by Examples and Experiments shown below.

Figure 1:
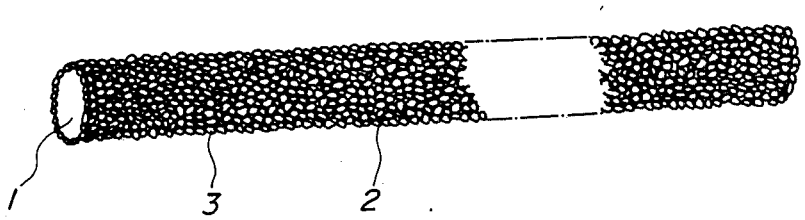
FIG. 1 is a steric view of a tendon made of fiber reinforced plastic showing one embodiment of the present invention.
Figure 2:
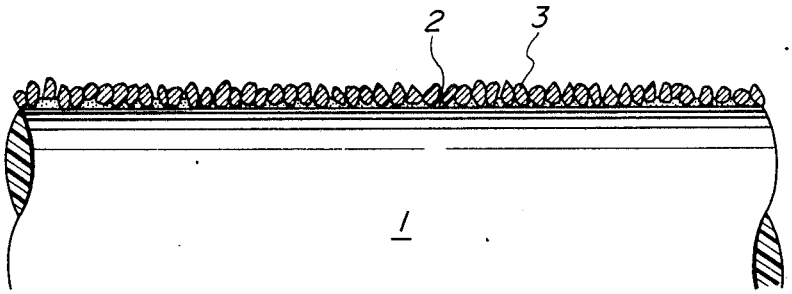
FIG. 2 is a partially enlarged sectional view of the tendon.

FIG. 1 is a steric view showing an example of a tendon for PC according to the present invention, and FIG. 2 is a partially enlarged sectional view of FIG. 1.

In the drawings, a reference numeral 1 designates a FRP-made rod, 2 designates a plastic adhesive layer formed on the outer circumferential surface of said rod, and 3 designates inorganic particles coated on said adhesive layer 2 with a part thereof embedded into said adhesive layer 2 and a part thereof exposed to the surface.

Preparation of Samples:

Example I

A glass roving impregnated with unsaturated polyester resin was drawn through a molding die, heated and hardened to obtain an FRP-made rod having a diameter of 8 mm.

Unsaturated polyester resin (type of being hardened at normal temperature) was thinly coated on the outer circumferential surface of the thus obtained FRP-made rod to form a plastic adhesive layer, and silicon carbide (SiC) having an average particles size of 1000$\mu$ was evenly coated on said adhesive layer to obtain an FRP-made tendon for PC, which was used as a sample A.

Example II

An FRP-made rod having a diameter of 8 mm reinforced by glass fibers was obtained likewise the above-described Example I.

Unsaturated polyester resin (type of being hardened at normal temperature) was thinly coated on the outer circumferential surface of the thus obtained FRP-made rod to form a plastic adhesive later, and silicon carbode (SiC) having an average particle size of 210$\mu$ was evenly coated on said adhesive layer to obtain an FRP-made tendon for PC, which was used as a sample B.

Example III

A carbon fiber roving impregnated and coated with epoxy resin was drawn through a molding die, heated and hardened to obtain an FRP-made rod having a diameter of 8 mm.

Epoxy resin (type of being hardened at normal temperature) was thinly coated on the outer circumferential surface of the thus obtained FRP-made rod to form a plastic adhesive layer, and aluminum oxide ($Al_2O_3$) having an average particle size of 1000$\mu$ was evenly coated on said adhesive layer to obtain an FRP-made tendon for PC, which was used as a sample C.

Comparative Example I

A glass roving impregnated and coated with unsaturated polyester resin was drawn through a molding die, heated and hardened to obtain an FRP-made rod having a diameter of 8 mm, which was used as a tendon for PC without modification and used as a comparative sample D.

Comparative Example II

A carbon fiber roving impregnated and coated with epoxy resin was drawn through a molding die, heated and hardened to obtain an FRP-made rod having a diameter of 8 mm, which was used as a tendon for PC and used as a comparative sample E.

COMPARATIVE EXAMPLE III

A glass roving impregnated and coated with unsaturated polyester resin was drawn through a molding die, heated and hardened to obtain an FRP-made rod having a diameter of 8 mm.

A glass roving (a 200-piece bundle having a diameter of 8$\mu$) impregnated with epoxy resin was continuously and spirally wound with a pitch spacing of 2 mm on the outer circumferential surface of the thus obtained FRP-made rod, heated and hardened to obtain an FRP-made rod having spiral projections in the outer circumferential surface thereof, which was used as a tendon for PC and used as a comparative sample F.

COMPARATIVE EXAMPLE IV

A PC steel wire having a diameter of 8 mm was prepared to use as a comparative sample G.

Testing Method:

Both ends of the tendon of the aforementioned samples A–C and comparative samples D–G are held and each sample is pulled by a load 70% of a breaking load of each sample to intrduce a tension of each sample.

This is set into a mold prepared in advance, and thereafter concrete is introduced into said mold.

Figure 3:
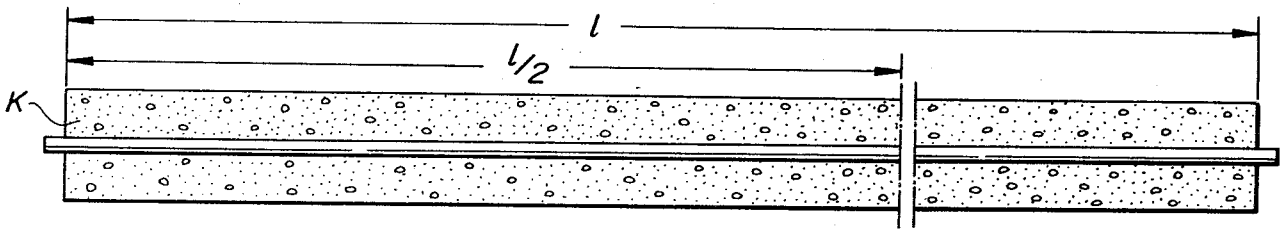
FIG. 3 is a sectional view showing a prestressed concrete structure which uses said tendon.

After concrete has been hardened, a strain gauge was fixed, along the direction of the tendon, on the surface of a concrete structure K, and gripping of the tendon was released. Thereafter, surface strains at various points of the concrete structure K were measured and the prestress force introduced into the concrete structure K was measured (see FIG. 3).

For the concrete structure K, a rectangular parallelepiped of length (l) 1200 mm, height 100 mm and width 100 mm was used.

Tensions (70% of a breaking load of samples) introduced into samples are as shown in the following Table.

| Sample No. | Tension |
|---|---|
| Samples A and B | 3.8 ton |
| Sample C | 5.0 ton |
| Comparative sample D | 3.8 ton |
| Comparative sample E | 5.0 ton |
| Comparative sample F | 3.8 ton |
| Comparative sample G | 5.0 ton |

Figure 4:
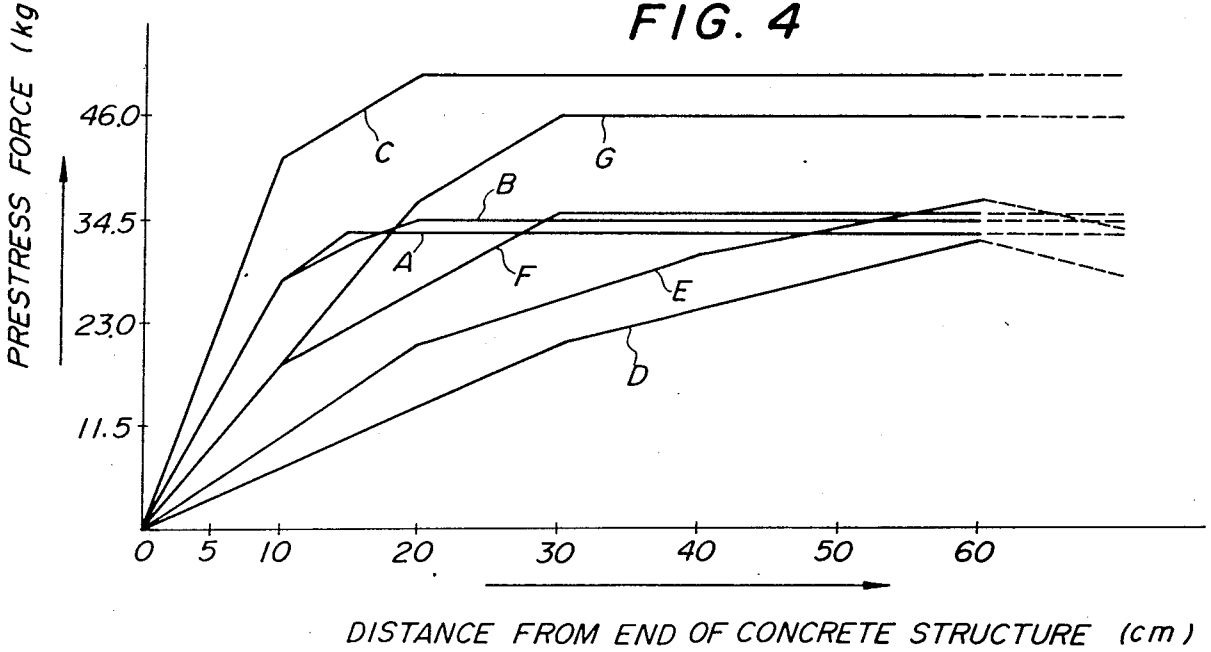
FIG. 4 is a graph showing the experimental results while comparing prestress forces.

The test results obtained in the above-described manner are as shown in FIG. 4.

FIG. 4 shows the prestress force introudced into the structure K from the end of the concrete structure K to the central portion lengthwise of the structure K. In FIG. 4, reference numerals correspond to those of respective samples and comparative samples.

Generally, in the PC structure formed by the pretensioning method, an area from the end of the PC structure to a portion in the neighbourhood thereof is hard to introduce a significant prestress force due to the relaxation of the tension.

This results from the fact that the relaxation of the tension introduced into the tendon is greater than the adhesive force between the tendon in said part and the concrete. However, in the PC structure formed by the pretensioning method, it is preferred that the great prestress force is introduced to the end of the concrete structure as the requirement required for the PC tendon in the aforementioned pretensioning method.

However, as is clear from FIG. 4 showing the experimental results, in the concrete structure using the tendon in the example of the present invention as shown at A, B and C therein, a great prestress force is introduced into the end of the aforesaid structure.

It is truly represented that the adhesion between the inorganic particles uniformly coated and formed on the outer circumferential surface of the FRP-made rod and the concrete and the mechanical frictional engagement of the concrete with the minute rugged surface portions formed by the inorganic particles are well effected.

Particularly, comparing with the tendon comprising the comparative example III shown at F, it is apparent there is a difference between the tendon in the example of the present invention and one having projections spirally formed on the outer circumferential surface of the FRP-made rod. That is, the mere formation of the projections on the outer circumferential surface of the FRP-made rod is greatly different from those (indicated at D and E) which use the FRP-made rod as a tendon, but shows the tendency similar to one (indicated at G) which uses a steel wire as a tendon, and as in prior arts, the prestress force is hard to be introduced into the neighbourhood of the end of the concrete structure.

The aforementioned experiments result from the use of the tendon for PC with inorganic particles uniformly coated and formed on the whole outer surface of the FRP-made rod, and the allowing can be understood from the experimental results.

Accordingly, in view of the introduction of prestress into the concrete structure, the inorganic particles of the present invention can be coated on the outer surface of the fixed portion of the FRP-made rod.

More specifically, in the case of the FRP-made rod having a length of 1200 mm, the inroganic particles are coated on the outer surface thereof from the end of the rod over the range from 150 to 200 mm whereby the prestress may be introduced into the end of the concrete structure.

This has been confirmed by carrying out the same experiment as in the example of the aforementioned sample C.

A carbon fiber roving impregnated and coated with epoxy resin was drawn through a molding die, heated and hardened to obtain an FRP-made rod having a diameter of 8 mm and a length of 1200 mm, the outer surface of the rod is thinly coated with the epoxy resin from the end thereof over the range of 200 mm in an axial direction to form an adhesive layer, and thereafter a tendon for PC made of FRP formed by coating aluminum oxide of average particle size 1000$\mu$ on the adhesive layer was obtained. As the result of experiment conducted by the aforementioned testing method, the PC tendon showed the result similar to that of the reference numeral C of FIG. 4.

From the above-described experimental results in view of the introduction of prestress into the concrete structure, the inorganic particles are (1) coated and formed over the whole outer surface of the FRP-made rod and (2) are coated and formed on the fixed portion of the outer surfaces on both ends of the FRP-made rod whereby the prestress may be introduced over the approximately full length of the concrete structure, thus meeting one of the requirements required by the PC tendon in the aforementioned pretensioning method.

Next, experiments conducted on the checking operation of the width of and length of cracks in concrete which forms a further requirements required by the PC tendon in the pretensioning method will be explained.

Samples:

Sample I: A PC tendon similar to that of the aforementioned Example III was used.

Sample II: An FRP-made rod similar to that of the aforementioned Examples III was used, and a PC tendon was used in which aluminum oxide of average particle size 1000μ coated and formed on the outer surface of the fixed portion from the end of the rod.

Testing Method:

The aforesaid sample I and sample II were used to obtain a PC structure (a rectangular parallelopiped having a length of 1200 mm, a height of 100 mm and a width of 100 mm) in a manner similar to that of the aforementioned testing method, the PC structure being supported at points 250 mm from ends thereof (span: 700 mm). Loads were successively and cumulatively applied to the central portion of the PC structure.

Figure 6:
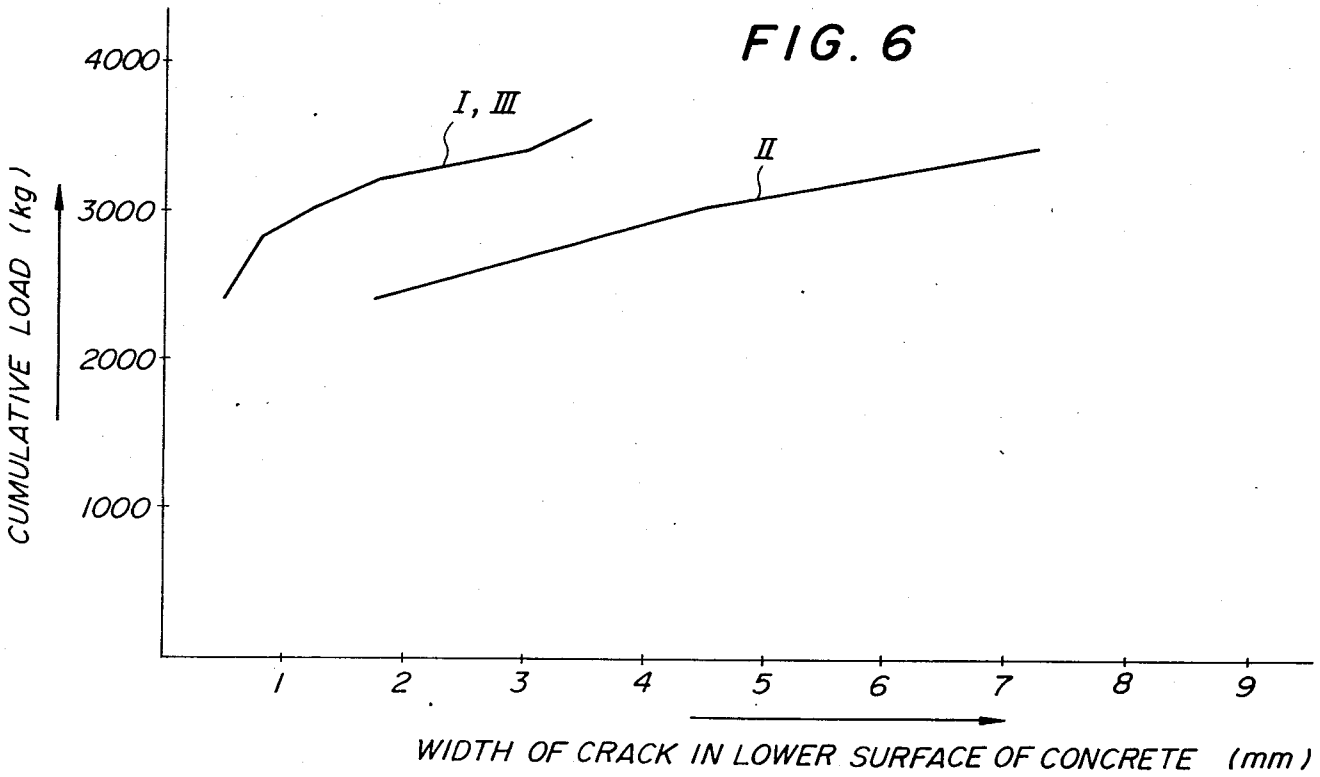
FIG. 6 is a graph showing experimental results while comparing widths of cracks.

FIG. 6 is a graph showing the relationship between the cumulative load and the width of cracks ocurring in the PC structure.

In FIG. 6, a reference I corresponds to the sample I, and a reference II corresponds to the sample II.

It has been found from the experimental results that in the PC tendon (sample I) having the whole outer surface of the FRP-made rod coated and formed with inorganic particles, the rate of increase in width of cracks occurring in the structure is slow with respect to an increase in load whereas in the PC tendon (sample II) having only the fixed portion of the outer surfaces on both ends of the rod coated and formed with inorganic particles, the rate of increases in width of cracks is abrupt with respect to an increase in load.

This crack occurred at a portion where maximum bending moment occurs in the PC structure, and a difference in adhesive force between the PC tendon and concrete at said portion brings forth the aforesaid results.

That is, good results were obtained in view of the introduction of prestress into the aforementioned concrete structure. The PC tendon (sample II) having the fixed portion coated with inorganic particles is not suitable for its use, from the experimental results, for applications where bending moment mainly exerts on the PC structure in view of checking the width of cracks.

Sample III was tested in consideration of the above-described results.

Figure 5:
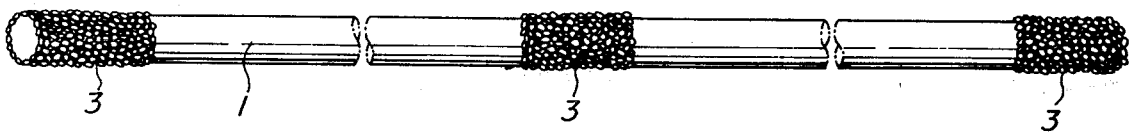
FIG. 5 is a steric view of a tendon made of fiber reinforced plastic showing a further embodiment of the present invention.

Sample III: An FRP-made rod similar to that of the aforementioned example III was used, and a PC tendon was used in which the outer surface of the fixed portion and the outer surface of a portion subjecting to maximum bending moment were coated and formed with aluminum oxide having an average particle size of 1000μ from the ends of the rod (FIG. 5).

When the sample III was tested by the above-described testing method, the result approximately similar to that of the aforesaid sample I was obtained as indicated at the reference numeral III in FIG. 6.

From the above-described experimental results, checking operation of width of cracks generated in loading the PC structure is achieved by the arrangement wherein the inorganic particles are coated and formed on the whole outer surface of the FRP rod, and wherein the inorganic particles are coated and formed on the outer surfaces of the fixed portions at both ends of the FRP rod and on the outer surface of the portion subjected to the maximum bending moment.

It will be easily understood that if a part subjected to bending moment which gives rise to cracks is found in advance other than those sujected to the maximum bending moment in the latter case as described above, inorganic particles may be coated and formed on said particular portion of the FRP-made rod to achieve the checking operation of the width of cracks.

From the aforementioned experimental results, the tendon for PC having the whole outer surface of the FRP-made rod is coated and formed with the inorganic particles and the tendon for PC having the fixed portions at both ends of the FRP-made rod and the outer surface of at least the portion subjected to the maximum bending moment coated and formed with the inorganic particles are suitable for use with mainly PC structures on which bending moment exerts, for example, such as girders, sleepers, guideway structures for floating railways, slabs for tracks, etc. and the tendon for PC having the outer surfaces of the fixed portions at both ends of the FRP-made rod coated and formed with the inorganic particles is suitable for use with concrete piles, underground walls, concrete-made posts, etc.

What is claimed is:

1. A tendon for pretensioning a concrete structure, comprising:

a rod-like or linear tendon formed of fiber reinforced plastic covered by a plastic adhesive layer, said adhesive layer on its outer surface having a dense and uniform mass of inorganic particles of a particle size ranging from 300 μm–1000 μm partially embedded therein.

2. The tendon according to claim 1, wherein said inorganic particles are selected from the group consisting of silicon carbide particles, aluminum oxide particles, silicon dioxide particles, glass particles and stainless steel particles.

3. A tendon for pretensioning a concrete structure, comprising:

a rod-like or linear tendon formed of fiber reinforced plastic, said tendon being covered by an adhesive plastic layer at both ends and in sections of the tendon which are to be subjected to the maximum bending moment in the concrete structure, said adhesive plastic layer covered sections having a dense and uniforms mass of inorganic particles of a particle size ranging from 300 μm–1000 μm partially embedded therein.

* * * * *